United States Patent [19]

Shy

[11] Patent Number: 4,889,193

[45] Date of Patent: Dec. 26, 1989

[54] ROTARY DRILL GUARD ASSEMBLY AND METHOD

[75] Inventor: Max H. Shy, Mauldin, S.C.

[73] Assignee: McLaughlin Manufacturing Company, Greenville, S.C.

[21] Appl. No.: 204,703

[22] Filed: Jun. 10, 1988

[51] Int. Cl.[4] ..... E21B 7/00; E21B 19/08

[52] U.S. Cl. ..... 175/62; 175/203; 175/219; 175/220

[58] Field of Search ..... 175/62, 19, 203, 219, 175/220, 257; 173/46, 163

[56] References Cited

U.S. PATENT DOCUMENTS

| | | | |
|---|---|---|---|
| 3,078,933 | 2/1963 | Orner | 175/219 |
| 3,298,448 | 1/1967 | Kull | 175/19 |
| 3,651,872 | 3/1972 | Smith, Jr. et al. | 175/62 |

*Primary Examiner*—Jerome W. Massive, IV
*Assistant Examiner*—Terry Lee Melius
*Attorney, Agent, or Firm*—Bailey & Hardaway

[57] ABSTRACT

A guard assembly for encasing drive rods during below ground horizontal drilling is illustrated as including a tube positionable by an adjustable tube guide, which remains stationary during drilling, an expandable tube having a smaller diameter for telescoping into the larger tube, means attaching the smaller tube to the rotary drill power source for substantial encasement of the drive rod during drilling.

7 Claims, 2 Drawing Sheets

ROTARY DRILL GUARD ASSEMBLY AND METHOD

BACKGROUND OF THE INVENTION

Utility installation by horizontal boring, commonly referred to as moleing, consists of utilizing rotating lengths of segmental drive rods from a power source located above ground level, that in turn, rotate a flighted compaction head launched from an approach trench below the ground surface. The drive rod is flexible between the compaction head and the power source enabling the system to run subsurface while the power source remains above ground.

Therefore, exposed rotating drive rod between the power source and the point in which the rod goes below the ground surface, poses a potential hazard area. The rotating rod when left exposed can entangle clothing and/or other objects working in close proximity to the rod. Since a section of drive rod must be advanced continuously during drilling, encasement procedures have heretofore proved impractical.

It is an important object of this invention to provide a rotary compaction rod guarding system designed to encase the rotating rod between the power source and the point where the rod becomes buried into the earth.

Another important object of this invention is the provision of a guard assembly for a drilling system having a first tube securable to the drilling system encasing a portion of the drive rod attached to that system, and at least one other tube encasing the drive rod with all tubes being of different diameters to allow for telescoping.

Another important object of this invention is the provision of a guard assembly for a drilling system which automatically discontinues drilling when the guard assembly is disengaged.

It is yet another object of this invention to provide a drilling method which prevents the clothing of the user from becoming entangled in the drilling system.

SUMMARY OF THE INVENTION

It has been found that a guard assembly for a rotary drill system may be provided utilizing telescoping tubes which encase the drive rod of the drill system between the power source and the point where the rod becomes buried into the ground. One of the tubes is secured to the drilling system and its power source so that removal of the guard assembly from the drilling system automatically discontinues drilling.

BRIEF DESCRIPTION OF THE DRAWINGS

The construction designed t carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
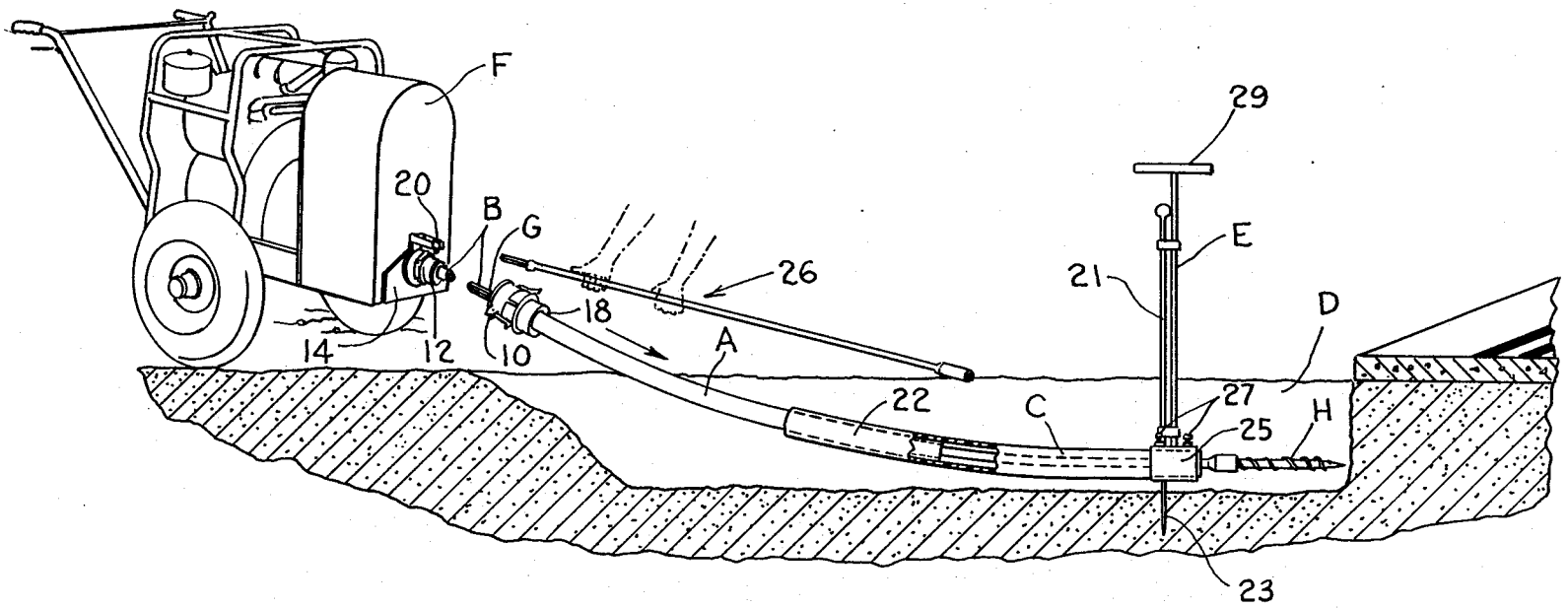
FIG. 1 is a perspective view, with parts broken away, illustrating a guard assembly constructed in accordance with the present invention.

The drawings illustrate a guard assembly for loosely encasing a drive rod of a rotary drilling system for horizontal below ground drilling. A first tube A is provided with suitable disconnect means B for securing the tube to the drilling system encasing a portion of the drive rod attached to a power source of the drilling system. At least one other tube C is provided for encasing the drive rod. The tubes are of different diameters allowing for telescoping of the tubes as the drilling system is moved forwardly in a drilling operation thereby encasing a portion of the drive rod during drilling. Thus, removal of the first tube from the drilling system allows for telescoping of the tubes away from the power source exposing the drive rod for adjustment of drive rod length. The other tube C is a second tube guiding the drive rod adjacent to the point of drive rod entry into the ground. The second tube preferably has a diameter greater than the first tube permitting telescoping of the first tube into the second tube.

The tube C is positionable in an entrance trench D by means E. The rotary drilling system comprises a power source F, drive rods G and drill head H.

Referring more particularly to the drawings, the means B, for releasing and securing the first tube A to the drilling system, is a quick coupling release 10 securable to a coupling adaptor 12 which is attached to power source F at the point where the machine chuck 16 protrudes from the power source F. The machine chuck 16 drives the expandable drive rod G. The coupling adaptor 12 is positioned about the protruding machine chuck 16 and is attached to the power source by bracket 14. Coupling adaptor 12 is a short tube having a narrowing portion 13 with an enlarged rim 15. Coupling release 10 secures on to adaptor 12 as shown at 17. Thus, when release 10 is secured to adaptor 12, release 10 is also about machine chuck 16, see FIG. 2. The quick coupling release 10 preferably threadably attaches to first tube A as at 18.

Figure 2:
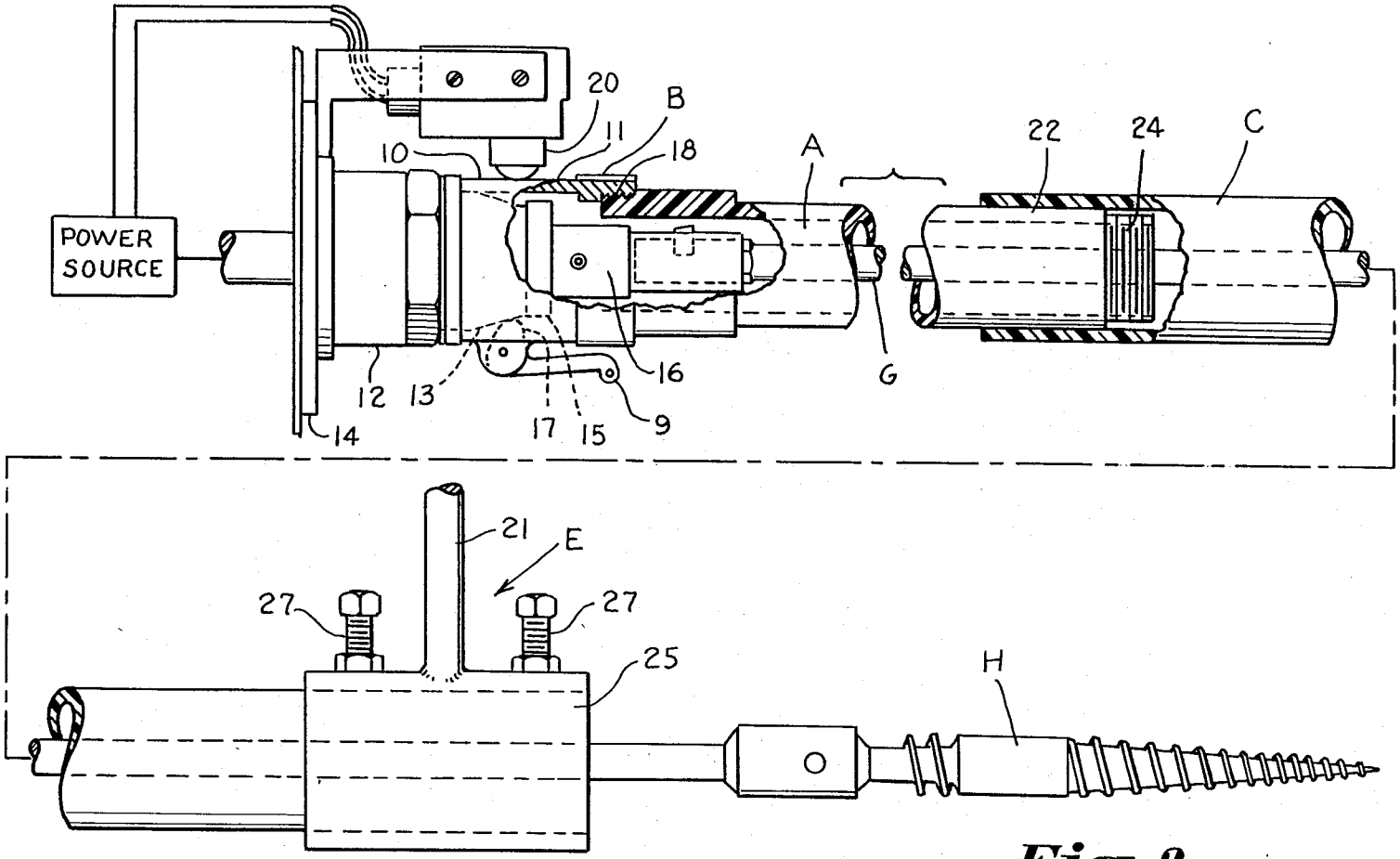
FIG. 2 is a longitudinal sectional elevation of the guard assembly of FIG. 1 illustrating the interlocking means for joining and permitting disassembly of the components forming the guard assembly.

Securing the quick coupling release 10 to coupling adaptor 12 activates switch 20. Referring particularly to FIG. 2, note that the outer surface 11 of quick coupling release 10 is an annular flange which depresses switch 20 regardless of the orientation of release 10 about adaptor 12. That is, release 10 may be secured to adaptor 12 in any rotational position except for those prohibited by interference of lever 9 with switch 20. Thus, it is an important part of this invention that the user may quickly snap release 10 on to adaptor 12 without regard to any particular positioning required to activate switch 20. If the release is secured to the adaptor, switch 20 is automatically depressed. Switch 20 is in direct communication with the power source so that activation of switch 20 permits power flow and, therefore, permits drilling, and deactivation of switch 20, by the release of quick coupling release 10 from coupling adaptor 12, stops the power flow and automatically discontinues drilling. Thus, switch 20 is a safety mechanism prohibiting drilling when the drive rod G is exposed.

Referring now to the opposite end of the guard assembly, tube C is positioned in entrance trench D prior to drilling by means E. Means E is adjustable tube guide 21. Tube guide 21 has a spike 23 which protrudes into the ground providing stability. Tube C is telescoped into encasement 25 and held therein by set screws 27. The vertical positioning of tube C is then adjusted by thumb screw 29. Furthermore, tube C is held in position during drilling by means E. That is, one person may hold thumb screw 29 stable while another person operates the drilling system. Thus, it is preferable to have two users operating the present system at any one time. Tube A telescopes into tube C as at 22. As noted by the threads 24 of FIG. 2, tube A may be expanded by securing additional lengths of tubing of the same diameter. Although only two tubes are shown in each of the figures of the drawings as comprising the primary elements of this invention, it is to be understood that any number greater than 2 of these tubes could be employed so long as they are of different diameters to allow telescoping. The number of tubes needed for any given job would depend on the flexibility required and therefore on the length and depth of the entrance trench.

OPERATION

The present invention provides a safe means for moleing because the drill rods may be substantially encased. The preferred method of operation includes the steps of:

A. digging an entrance trench D;

B. positioning tube C in entrance trench D so that one end is adjacent to the place in the ground where drilling is to begin;

C. partially telescoping tube A into tube C as shown at 22;

D. running expandable drive rod G carrying drill head H through the tubes;

E. securing tube A to the drilling system by means B.

F. advancing the drive rod G into the ground as the tubes telescope together;

G. releasing tube A from the drilling system by means B;

H. releasing drive rod G from power source F;

I. expanding the expandable drive rod G by a length as shown at 26;

J. backing the power source by a distance substantially equal to the length of expansion of drive rod G;

K. reattaching the drive rod G to the power source F; and

L. pulling tube A back to the power source.

Steps E through L are repeated until a desired bore length is achieved. Throughout the drilling process tube C is held stationary by means E to assure a straight bore.

While a preferred embodiment of the invention has been described using specific terms, such description is for illustrative purposes only, and it is to be understood that changes and variations may be made without departing from the spirit or scope of the following claims.

What is claimed is:

1. A guard assembly for loosely encasing a drive rod of a rotary drilling system for horizontal below ground drilling comprising:

a first tube releasably secured to the drilling system encasing a portion of the drive rod attached to a power source of the drilling system;

at least one other tube encasing the drive rod remote from the drilling system in telescoping relation with said first tube; and said tubes being of different diameters allowing for telescoping of said tubes as the drilling system is moved forwardly in a drilling operation thereby encasing a portion of the drive rod during drilling;

whereby removal of the first tube from the drilling system allows for telescoping of the tubes away from the power source exposing an end of the drive rod for adjustment of drive rod length.

2. The structure set forth in claim 1 wherein said at least one other tube is a second tube guiding the drive rod adjacent to the point of drive rod entry into the ground, said second tube having a diameter greater than the first tube permitting telescoping of the first tube into the second tube.

3. The structure set forth in claim 2 wherein the second tube is positionable prior to drilling by an adjustable tube guide.

4. The structure set forth in claim 3 wherein the second tube is held stationary during drilling by said tube guide thereby assuring a straight line.

5. The structure set forth in claim 1 including a switch actuated responsive to disconnection of the first tube from the drilling system resulting in automatic stoppage of power flow thereby preventing drilling while the drive rod is exposed.

6. A method of horizontal below ground drilling utilizing a power operated driving system comprising the steps of:

A. digging an entrance trench;

B. positioning a tube in the trench with one end of the tube adjacent a point in the end of the trench where drilling is to begin;

C. partially telescoping at least one other tube into said tube positioned in the trench;

D. running an expandable drive rod attached to a power source of the drilling system through the tubes into the ground for connection to a drill bit;

E. securing one end of said at least one other tube remote from said tube positioned in the trench to the drilling system;

F. advancing the drive rod into the ground as the tubes are telescoped together;

G. releasing the end of said at least one other tube secured to the drilling system;

H. releasing the expandable drive rod from the power source;

I. expanding the expandable drive rod by a length;

J. backing the power source by a distance substantially equal to the length of expansion of the drive rod;

K. reattaching the drive rod to the power source; and

L. pulling and reconnecting the tube released from the drilling system to the power source.

7. The method of claim 6 including discontinuing drilling when the second tube is released from the drilling system.

* * * * *